US007500905B2

(12) United States Patent
Iga

(10) Patent No.: US 7,500,905 B2
(45) Date of Patent: Mar. 10, 2009

(54) GRINDING APPARATUS AND GRINDING SYSTEM

(75) Inventor: Kiyoshi Iga, Nagoya (JP)

(73) Assignee: Toyota Jidosha Kabushiki Kaisha (JP)

( * ) Notice: Subject to any disclaimer, the term of this patent is extended or adjusted under 35 U.S.C. 154(b) by 128 days.

(21) Appl. No.: 11/596,221

(22) PCT Filed: Feb. 15, 2006

(86) PCT No.: PCT/JP2006/303101

§ 371 (c)(1),
(2), (4) Date: Nov. 14, 2006

(87) PCT Pub. No.: WO2006/098119

PCT Pub. Date: Sep. 21, 2006

(65) Prior Publication Data

US 2008/0064304 A1 Mar. 13, 2008

(30) Foreign Application Priority Data

Mar. 15, 2005 (JP) ..... 2005-073365

(51) Int. Cl.
*B24B 1/00* (2006.01)

(52) U.S. Cl. ..... 451/57; 451/59; 451/261; 451/268; 451/283

(58) Field of Classification Search ..... 451/184, 451/195, 261, 907, 909, 57, 59, 490, 508, 451/260, 268, 283, 285
See application file for complete search history.

(56) References Cited

U.S. PATENT DOCUMENTS 4,793,057 A * 12/1988 Kamiyama et al. ..... 29/822

(Continued)

FOREIGN PATENT DOCUMENTS

JP 04-93195 3/1992

(Continued)

OTHER PUBLICATIONS

PCT International Preliminary Report on Patentability and Written Opinion of the International Searching Authority mailed Sep. 27, 2007, for Application No. PCT/JP/2006/303101, 5 pages.

*Primary Examiner*—Eileen P. Morgan
(74) *Attorney, Agent, or Firm*—Finnegan, Henderson, Farabow, Garrett & Dunner, LLP

(57) ABSTRACT

A grinding apparatus and a grinding system capable of efficient and superior grinding performance prevent the falling of a belt during the grinding of an edge surface thereof. The apparatus includes two rotating bodies 31 and 32 each having segment brushes 4, 4, . . . attached in the circumferential direction at the edge thereof. The rotating bodies 31 and 32 are rotated in the same direction. The tip of the segment brushes 4, 4, . . . is opposed to one edge surface of a belt b stretched between a driving roller 21 and a driven roller 22. The segment brushes 4 of the two rotating bodies enter toward the belt b at appropriate locations on the one edge surface, such that the falling of the belt can be prevented. A grinding apparatus 1 includes a grinder 3 consisting of the rotating bodies 31 and 32, and a holder consisting of the rollers 21 and 22 and a casing 23 by which the rollers are rotatably supported. A plurality of such grinding apparatuses 1 are disposed at regular intervals, whereby a grinding system 10 is constructed.

9 Claims, 18 Drawing Sheets

U.S. PATENT DOCUMENTS

| | | | | |
|---|---|---|---|---|
| 5,772,495 | A * | 6/1998 | Sanda et al. | 451/69 |
| 6,428,390 | B1 * | 8/2002 | Clark et al. | 451/11 |
| 6,986,703 | B2 * | 1/2006 | Weber | 451/285 |
| 2006/0211343 | A1 * | 9/2006 | Yoshimura et al. | 451/51 |

FOREIGN PATENT DOCUMENTS

| | | |
|---|---|---|
| JP | 11-333682 | 12/1999 |
| JP | 2004-261882 | 9/2004 |

* cited by examiner (a)

(b)

GRINDING APPARATUS AND GRINDING SYSTEM

TECHNICAL FIELD

The present invention relates to a grinding apparatus for grinding an edge surface of a belt stretched between two rollers, and to a grinding system including a plurality of such grinding apparatuses. Particularly, the invention relates to a grinding apparatus and a grinding system capable of efficient and superior grinding performance by preventing the falling of the belt during the grinding of the belt edge surface.

BACKGROUND ART

A metal CVT belt for high load transmission used in a continuously variable transmission (CVT) is formed of belt stacks each consisting of circular belts, the belt stacks being arranged in the width direction of the belt. The belt stacks are each locked and fastened with a plurality of blocks (elements). For example, as shown in FIG. 18*a*, circular belts a, a, . . . are stacked to form a stack b, and such stacks b, b are fitted in a plurality of blocks c, c, . . . to form a CVT belt d. The circular belt a is formed as follows. Edges of metal plates are welded to form a cylindrical metal drum of the thin plates. The metal drum is entirely subjected to heat treatment (solution treatment) so as to conform the welded portion and the base material to each other. Thereafter, the metal drum is sheared with an external roll cutter abutted against an internal roll cutter disposed inside the cylinder. The circular belts thus cut are subjected to barrel polishing in a final step. Barrel polishing involves putting a polished member (work) and a polisher (medium) in a barrel (container) so as to remove burrs by the relative friction of the work and the medium caused by the motion of the barrel, or to perform surface processing, such as providing a corner with an R.

During the cutting by the roll cutters, a burr a1 (outwardly stretched projection) or a droop (inwardly stretched depression in the width direction of the belt) are often caused, as shown in FIG. 18*b*. In order to remove such burr or droop, the aforementioned barrel polishing is performed. Further, an oxide film a2 with a thickness of approximately 1 μm, which is formed on the surface of the belt during solution treatment and that prevents the nitriding of the belt surface, can also be removed by barrel polishing. Barrel polishing can be further used for providing a corner of the belt edge surface with a smooth curve (radiusing).

As mentioned above, during the conventional CVT belt formation process, barrel polishing is performed to remove oxide films, burrs, or droops. However, such barrel polishing is not capable of completely removing the burrs or droops. The removal of the oxide film formed on the belt surface takes approximately one hour, resulting in decrease in the belt production efficiency. In addition, such barrel polishing produces large quantities of waste material of the medium, the disposal of which is a significant problem.

Reference 1 discloses an invention directed to a processing method for grinding the edges of a belt that does not involve the barrel polishing step. In this processing method, metal rings cut out of a metal drum are rotated in their circumferential direction, while a polishing brush, which is disposed to intersect the trajectory of the metal rings as they rotate at an incident angle of 20° to 45°, is abutted against the ring edge surface to polish the same. The polishing brush is similarly moved away from the metal rings at a withdrawal angle of 20° to 45°. These angular ranges are adopted for the following considerations. Namely, if the incident angle is less than 20°, the polishing brush would polish the internal circumferential surface of the metal rings. If the incident angle and the withdrawal angle exceeds 45°, only the tip of the side edge of the metal rings would be polished.

Patent Document 1: JP Patent Publication (Kokai) No. 2004-261882 A

DISCLOSURE OF THE INVENTION

In accordance with the metal ring processing method of Reference 1, burrs or the like on the metal ring edge surface can be removed without barrel polishing. However, the metal rings are pushed and caused to fall in the direction in which the polishing brush enters toward the metal rings, thereby failing to apply a desired polishing force to the metal rings. In order to prevent the falling of the metal rings, a jig could be attached to the processing apparatus along the external or internal circumference of the metal rings. However, because the metal belts to be produced have a variety of lengths, various jigs would have to be prepared for the various lengths of the metal rings to be produced.

In view of the foregoing problems, it is an object of the invention to provide a grinding apparatus and a grinding system that do not require any jigs for preventing the falling of the metal belt, and that are capable of preventing the formation of burrs or droops on the edge surface of the metal belt, or providing a corner of the edge surface with an R, even when the length of the metal belt is changed. It is another object of the invention to provide a grinding system capable of efficiently grinding the belt edge surface while eliminating the problem of the polishing brush being bent in one direction and without damaging the surface of the belt.

In order to achieve the aforementioned objects, the invention provides a grinding apparatus comprising:

two rollers rotating about two parallel axes; and a first grinding brush and a second grinding brush that repeatedly enter and emerge from between the two rollers, wherein a belt is stretched between the two rollers and is rotated by the rotation of the rollers, wherein the first grinding brush enters toward an edge surface of the belt from one side of the belt, while the second grinding brush enters toward the edge surface of the belt from the other side thereof.

Because the separate grinding brushes enter the edge surface of the rotating belt stretched between the two rotating rollers from two directions (one and the other side of the belt), the belt, which tends to fall in the direction in which the brushes enter on one side for grinding can be pushed back in the direction in which the brushes enter on the other side. Thus, the fall of the belt during grinding with the brushes can be prevented. The belt is stretched between the two rollers in the shape of a track (or a band), so that the brushes can enter appropriate points in a linear interval of the track from two directions. Because the belt does not fall during the brush grinding, the decrease in grinding force can be prevented. Burrs can be removed and a belt corner can be radiused by the brush grinding, as mentioned above. In addition to the prevention of the decrease in grinding force, the entry of the separate brushes toward the edge surface of the belt from two directions allow efficient radiusing.

The grinding brushes used are not particularly limited. For example, the so-called segment brushes can be used, which are comprised of a number of nylon wire rods bundled together to which grinding abrasive grains of alumina ($Al_2O_3$) or silicon carbide (SiC), for example, are fused. In this case, one end of the nylon wire bundle is housed in a metal cylinder, and the other end of the bundle is fitted in another metal cylinder, with the other end protruding from the metal cylinder a little, thus forming a grinding brush. The other end is pressed against the belt edge surface for grinding the same. Because the other end and its vicinity are restrained by the metal cylinder, certain rigidity of the brush can be ensured, and therefore the grinding force of the grinding brush can be maintained. Further, when the grinding brush end is worn by grinding, the end of the bundle housed in the metal cylinder can be pushed out so as to adjust the length of the nylon wire rods protruding from the metal cylinder.

In another embodiment of the grinding apparatus according to the invention, the apparatus further comprises:

a grinder comprising a first rotating body having a plurality of the first grinding brushes disposed in the circumferential direction thereof, and a second rotating body having a plurality of the second grinding brushes in the circumferential direction thereof, wherein the first rotating body and the second rotating body are spaced apart from each other such that the first grinding brushes and the second grinding brushes do not interfere with each other; and a holder disposed at a position opposite the grinder and equipped with the at least two rollers for holding the belt, wherein the first rotating body and the second rotating body are rotated in the same direction.

For example, a plurality of the aforementioned segment brushes are attached to the first and second rotating members (in the circumferential direction of the rotating bodies at intervals). The two rotating bodies are mounted at an end of a casing, in which a motor is housed. The two rotating bodies are spaced apart from each other such that they do not interfere with each other, and they form a grinder. The two rotating bodies are each attached to separate motor-driven shafts. The rotating bodies are preferably rotated in synchronism.

At a position opposite the grinder (or the two rotating bodies attached thereto), a holder is provided to which the aforementioned two rollers are attached at an end of the casing in which a motor is mounted. After the belt is stretched between the rollers of the holder, the holder and the grinder are moved toward each other such that the segment brushes attached to the two rotating bodies are positioned to abut the belt edge surface. One or both of the holder and the grinder are made movable, so that they can be moved toward each other.

The grinding apparatus is thus formed by the aforementioned grinder and the holder, so that the grinding of the edge of the belt can be automatically processed after the belt is stretched between the rollers. When the brushes are worn by grinding, the degree of the wear is detected by a pressure sensor mounted on the segment brushes, for example, and the other end of the nylon wire rods in the aforementioned embodiment can be automatically pushed out toward the belt.

In another embodiment of the grinding apparatus according to the invention, the rollers consist of a driving roller and a driven roller, of which one or both are movable such that one roller can be moved away from the other roller.

Because one of the two rollers is attached to the driving shaft of a motor so as to function as a driving roller, and the other roller functions as a driven roller driven via the belt, the two rollers can be rotated in synchronism.

One or both of the two rollers are made movable so that the distance between their axes can be appropriately changed. This allows the two rollers to be disposed at an appropriate distance such that the stretching of the belt can be facilitated. This also allows the two rollers to be distanced from each other such that, once the belt is stretched, an appropriate tension can be imparted to the belt in the longitudinal direction thereof for the grinding of the edge surface of the belt.

In another embodiment of the grinding apparatus according to the invention, the belt is a CVT belt comprised of a stack of a plurality of metal rings.

As mentioned above, by using the grinding apparatus of the invention for removing burrs at or providing an R to the edge of an CVT belt during the formation thereof, the need for a barrel grinding process is eliminated and the belt edge surface can be ground efficiently. Thus, the CVT belt is particularly suitable as the object of grinding.

The invention also provides a grinding system comprising a plurality of the aforementioned grinding apparatuses, wherein the system comprises a transfer means for sequentially transferring the belt and for allowing the belt to be detached from or attached to the rollers of each grinding apparatus, and wherein, after one edge surface of the belt is ground by an appropriate grinding apparatus, the other edge surface of the belt is ground by another grinding apparatus.

The grinding system of the invention comprises a plurality of the aforementioned grinding apparatuses, the system further comprising a transfer means for sequentially transferring the belt to the next grinding apparatus via the space between the holder and the grinder of which each grinding apparatus is comprised.

In accordance with the invention, the edge surfaces of the belt (the both edge surfaces of the belt stretched between the two rollers in the shape of an athletic track) are ground by the two grinding apparatuses sequentially. Each edge surface is coarsely ground and finish-ground alternately by separate grinding apparatuses. Thus, at least four grinding apparatuses are provided. In an embodiment of the sequence of grinding, one edge surface of the belt is coarsely ground, and then the belt is transferred to the next grinding apparatus, by which the other edge surface of the belt is coarsely ground. The belt is then transferred to the next grinding apparatus, by which the one edge surface is finish-ground. Thereafter, the belt is transferred to the next, final grinding apparatus by which the other edge surface of the belt is finish-ground. For alternately changing the edge surfaces of the belt that are ground, the positions where the holder and the grinder are disposed may be alternately reversed between the adjacent grinding apparatuses that are disposed at intervals.

The transfer means is not particularly limited. For example, two bar members are disposed in parallel and at an interval, and two chuck members are attached to the individual opposite surfaces of the pair of bar members for holding the belt as it is deformed in the shape of a track. In an embodiment, four of such pairs of the chuck members are attached to the bar members at the same intervals as those of the aforementioned four grinding apparatuses. One such pair of bar members is moved back and forth between the adjacent grinding apparatus disposed at intervals, whereby the belt of which one edge surface has been ground by one grinding apparatus can be transferred to the next grinding apparatus for grinding the other edge surface. A transfer belt conveyor is disposed forwardly of the final finish-grinding grinding apparatus. The belt that has been finished through the at least four stages of grinding processes is transferred onto the belt conveyor.

For example, the belt is set by the loader between the chuck members at one end via the shooter as the belt is deformed in the shape of a track. The pair of bar members is moved such that the chuck members holding the belt are positioned at the initial grinding apparatus. The holder of the grinding apparatus is moved toward the bar members, and the two rollers are inserted in the internal circumferential portion of the track. In this posture, the driven roller, for example, is moved away from the driving roller, whereby the belt in the shape of a track is tensioned in the longitudinal direction of the track. As the belt is tensioned in the longitudinal direction, the belt is further deformed to become thinner and longer than when it was held by the chuck members, whereby the belt is released from the chuck members. With the belt thus released from the chuck members, the driving roller is rotated, while the grinder is moved such that the grinding brushes of the grinder abut the edge surface of the belt. With the grinding brushes abutting against the edge surface of the belt with a predetermined pressurizing force, the two rotating bodies are rotated in the same direction. After a predetermined coarse grinding is completed, the driven roller is moved toward the driving roller, causing the track-shaped belt to be chucked by the chuck members, and then the holder is withheld from the bar members. The belt chucked by the chuck members is transferred to the next grinding apparatus by the movement of the bar members. In this grinding apparatus, too, a similar operation is carried out to coarsely grind the edge surface on the other side of the belt. Thereafter, similar operations are carried out to perform the polish-grinding of the both edge surfaces alternately, and the belt is eventually transferred to the belt conveyor. The difference between coarse grinding and polish-grinding is produced by varying the rod size of the brushes used for grinding or the grain size of the abrasive grains.

The transfer means is capable of transferring subsequent belts in a similar manner while it transfers one belt to the next grinding apparatuses sequentially as described above. Thus, it becomes possible to perform the sequence of coarse grinding to finish-grinding of the belt edge surfaces without any human intervention.

The grinding system according to the invention further comprises a grinding apparatus for grinding the internal and external circumferential surfaces of the belt.

As mentioned above, in CVT belts and the like, an oxide film is formed on the surface (external and internal circumferential surfaces) during solution treatment. In accordance with the grinding system of the invention, such oxide film is removed by grinding, in addition to the grinding of the belt edge surface. For example, in addition to the four grinding apparatuses already mentioned, another grinding apparatus is prepared. Such additional grinding apparatus comprises a grinding rotating body for grinding the external circumferential surface of the belt, and a grinding rotating body for grinding the internal circumferential surface of the belt. After the belt is held by the two rollers of the corresponding holder, the two grinding rotating bodies are each moved toward the belt, of which one comes into contact with the plane of a part of the external circumferential surface of the belt, while the other comes into contact with the plane of a part of the internal circumferential surface of the belt. With the two grinding rotating bodies thus in contact with the plane of the belt, the grinding rotating bodies are rotated, while the two rollers are also rotated, whereby the oxide film or the like attached to the external and internal circumferential surfaces of the belt can be ground and removed.

In the grinding system of the invention, the first rotating body and the second rotating body are adjusted such that their rotation direction is changed for each belt that is transferred.

In accordance with the invention, the direction of rotation of the two rotating bodies (first rotating body and second rotating body) in each grinding apparatus is reversed from one belt to another. If the direction of rotation of the rotating bodies were to be reversed during the processing of each belt, such reversal from forward rotation to backward rotation, for example, would take an additional time for acceleration and deceleration of the rotating bodies, possibly extending the grinding time. On the other hand, if the direction of rotation of the individual rotating bodies were to be fixed in one direction, the brushes would develop a tendency to flow in one direction, resulting in a decrease in grinding force. Thus, in accordance with the invention, instead of reversing the direction of rotation of the rotating bodies in each belt, the rotation direction of the rotating bodies is changed from one belt to another. In this way, the acceleration and deceleration time for the rotating bodies can be eliminated, whereby efficient grinding can be performed and the brushes can be prevented from acquiring any directional tendencies.

As will be understood from the foregoing, in accordance with the grinding apparatus and grinding system of the invention, the grinding brushes enter toward the edge surface of the belt from both sides of belt and perform grinding. As a result, the belt does not fall in one direction during grinding, so that efficient grinding can be performed while the initial grinding force is maintained. Furthermore, in accordance with the grinding system of the invention, the sequence of coarse grinding to finish-grinding of both edge surfaces of the belt, as well as the grinding of the internal and external circumferential surfaces of the belt, can be performed automatically. Thus, the grinding operation can be performed without any human intervention.

BRIEF DESCRIPTION OF THE DRAWINGS

FIG. 17(*a*) shows a conventional time history waveform, and FIG. 17(*b*) shows a time history waveform of the present invention.

FIG. 18(*b*) shows a cross section of the belt before and after barrel polishing.

NUMERALS IN THE DRAWINGS

1,1*a* . . . grinding apparatus; 2 . . . holder; 21 . . . driving roller; 22 . . . driven roller; 23 . . . casing; 3 . . . grinder; 31, 32 . . . rotating bodies (first rotating body, and second rotating body); 33 . . . casing; 34 . . . cylinder unit; 4 . . . segment brush; 41 . . . brushes; 42, 43 . . . cylinders; 5 . . . grinder; 51, 52 . . . grinding rotating bodies; 61 . . . loader; 62 . . . shooter; 71 . . . loader; 72 . . . belt conveyor; 8 . . . transfer (transfer means); 81, 82 . . . bar members; 83 . . . chuck member; 84 . . . legs; 91 . . . casters; 92 . . . rails; 10 . . . grinding system; b . . . belt

BEST MODE FOR CARRYING OUT THE INVENTION

Figure 1:
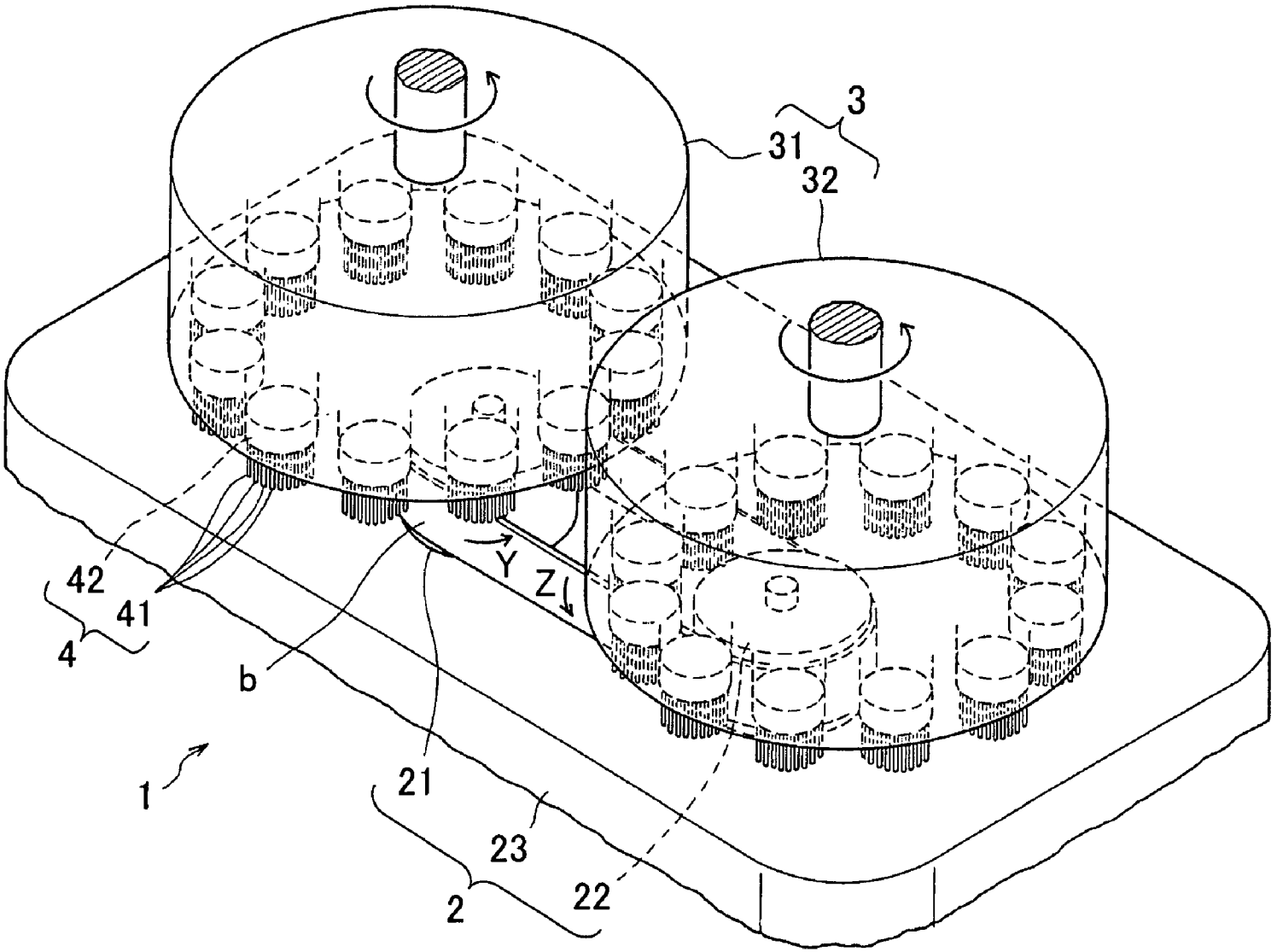
FIG. 1 shows a perspective view of a grinding apparatus of the invention.
Figure 2:
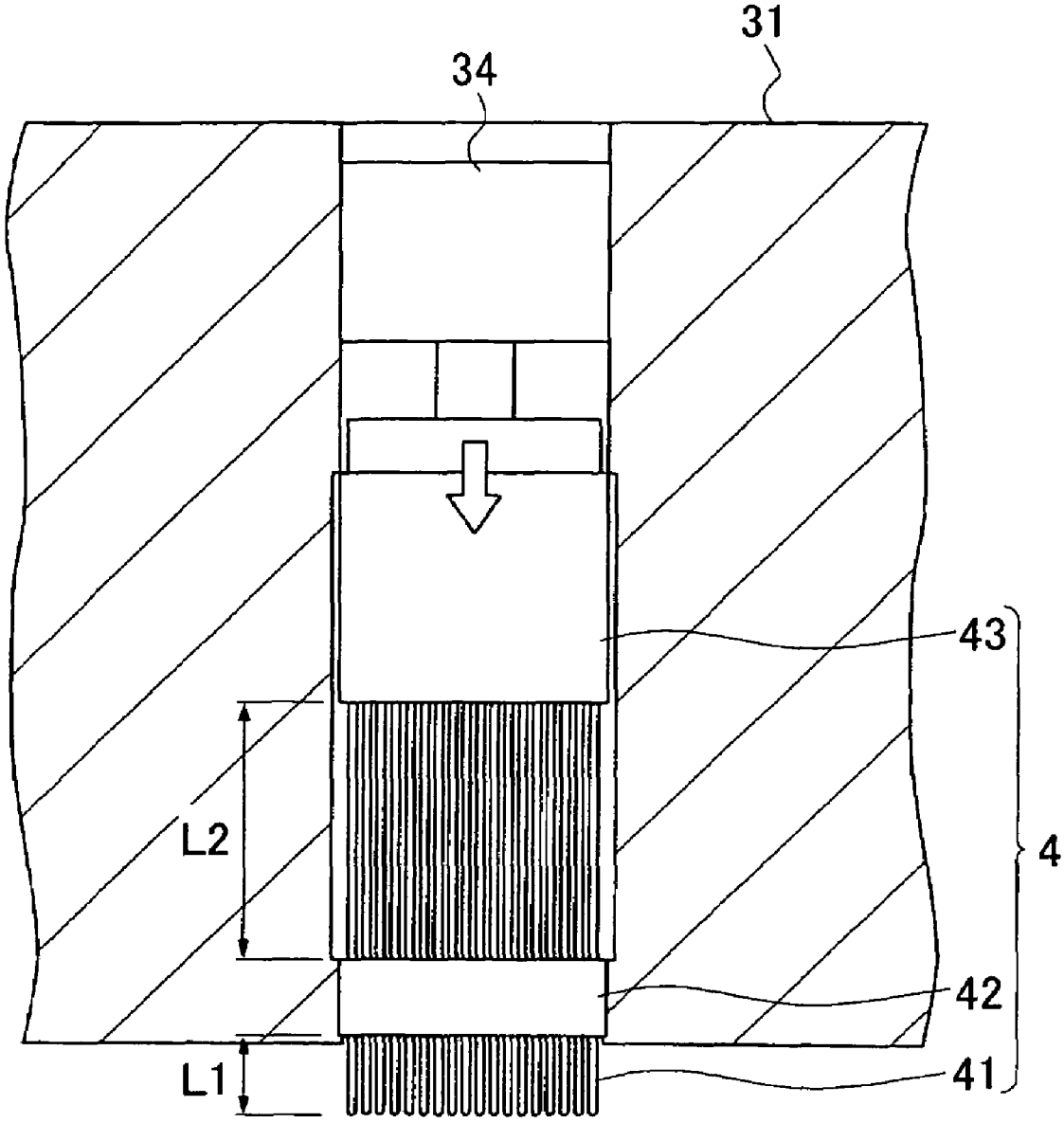
FIG. 2 shows a vertical section of a segment brush.

Embodiments of the invention will be described in the following with reference to the drawings. FIG. 1 shows a perspective view of a grinding apparatus according to the invention. FIG. 2 shows a vertical sectional view of a segment brush. FIGS. 3, 5, 7, 9, 11, 13, and 15 are plan views sequentially illustrating the operation of the grinding system. FIGS. 4, 6, 8, 10, 12, 14, and 16 are arrow views of FIGS. 3, 5, 7, 9, 11, 13, and 15, respectively. FIG. 17 shows a time history waveform during rotation control of a rotating body in the grinding apparatus. FIG. 17(*a*) shows a conventional time history waveform, while FIG. 17(*b*) shows a time history waveform according to the invention. In the illustrated embodiments, a metal belt (having a burr on the edge or an oxide film formed on the surface) is ground for a CVT belt. However, it goes without saying that the object to be ground is not limited to such metal belt.

A grinding apparatus 1 is comprised of, as shown in FIG. 1, a grinder 3 consisting of two rotating bodies 31 and 32, each having a plurality of segment brushes 4, 4, 4, . . . disposed in the circumferential direction thereof, and a holder 2 disposed opposite the tip of the segment brushes 4 for holding a belt b stretched between two rollers (a driving roller 21 and a driven roller 22). Regarding the holder 2, the two rollers are mounted on one side of a casing 23 in which a motor (not shown) is mounted for rotating the driving shaft of the driving roller 21. The driven roller 22 is movable on one side of the casing 23. For example, the rotating shaft rotatably supporting the driven roller is attached to the tip of the piston rod of a cylinder unit, so that the driven roller 22 can be moved toward or away from the driving roller 21 as the piston rod extends or withdraws. As to the grinder 3, on the other hand, the two rotating bodies 31 and 32 are mounted on one side of the casing, in which motors are mounted for rotating the rotating bodies 31 and 32.

The segment brushes 4 each consist of a number of nylon wire rods to which grinding abrasive grains of alumina ($Al_2O_3$) or silicon carbide (SiC), for example, are fused, the wire rods being bundled together with a metal cylinder 42. The segment brushes 4 protrude from the end surface of the rotating bodies 31 and 32 by a predetermined length.

As shown in FIG. 1, the rotating bodies 31 and 32 are controlled to rotate in the same direction. At an appropriate point in a linear interval of the belt b, which is stretched between the two rollers 21 and 22 in the shape of a track in a plan view, one rotating body 31 enters in a Y direction, while the other rotating body 32 emerges in a Z direction. By the grinding in such two directions, the belt, as it is ground by one rotating body, is prevented from falling in the direction in which the rotating body is rotated, by the rotation of the other rotating body. Further, it becomes possible to grind the two corners of the belt edge surface with the two rotating bodies at once, thus improving grinding efficiency. When extending the belt stretched between the two rollers 21 and 22 in the shape of a track, the driven roller 22 is moved away from the driving roller 21 after the belt is stretched between the two roller 21 and 22.

FIG. 2 shows how the segment brushes 4 are attached to the rotating bodies 31 and 32. One end of the nylon wire rods 41, 41, . . . in the segment brushes 4 is housed in a metal cylinder 43. The other end is fitted in the metal cylinder 42 such that the nylon wires are bundled thereby. The end of the cylinder 43 is closed, and the piston rod of a cylinder unit 34 is abutted against the end surface. In order to ensure the rigidity of the nylon wire rods during grinding, the length by which the nylon wire rods extend beyond the cylinder 42 is set to be a predetermined length (L1). As the tip of the nylon wire rods wears gradually by grinding and the grinding power decreases, the drop of grinding power is detected by a pressure senor (not shown). Based on the result of such detection, the piston rod may be extended by a predetermined length (in the direction X of the arrow). Because an extra length L2 is initially provided, the frequency of replacement of the segment brush can be minimized, whereby grinding efficiency can be improved.

In the following, the outline of the grinding system and the flow of its operation will be described with reference to FIGS. 3 to 16.

Figure 3:
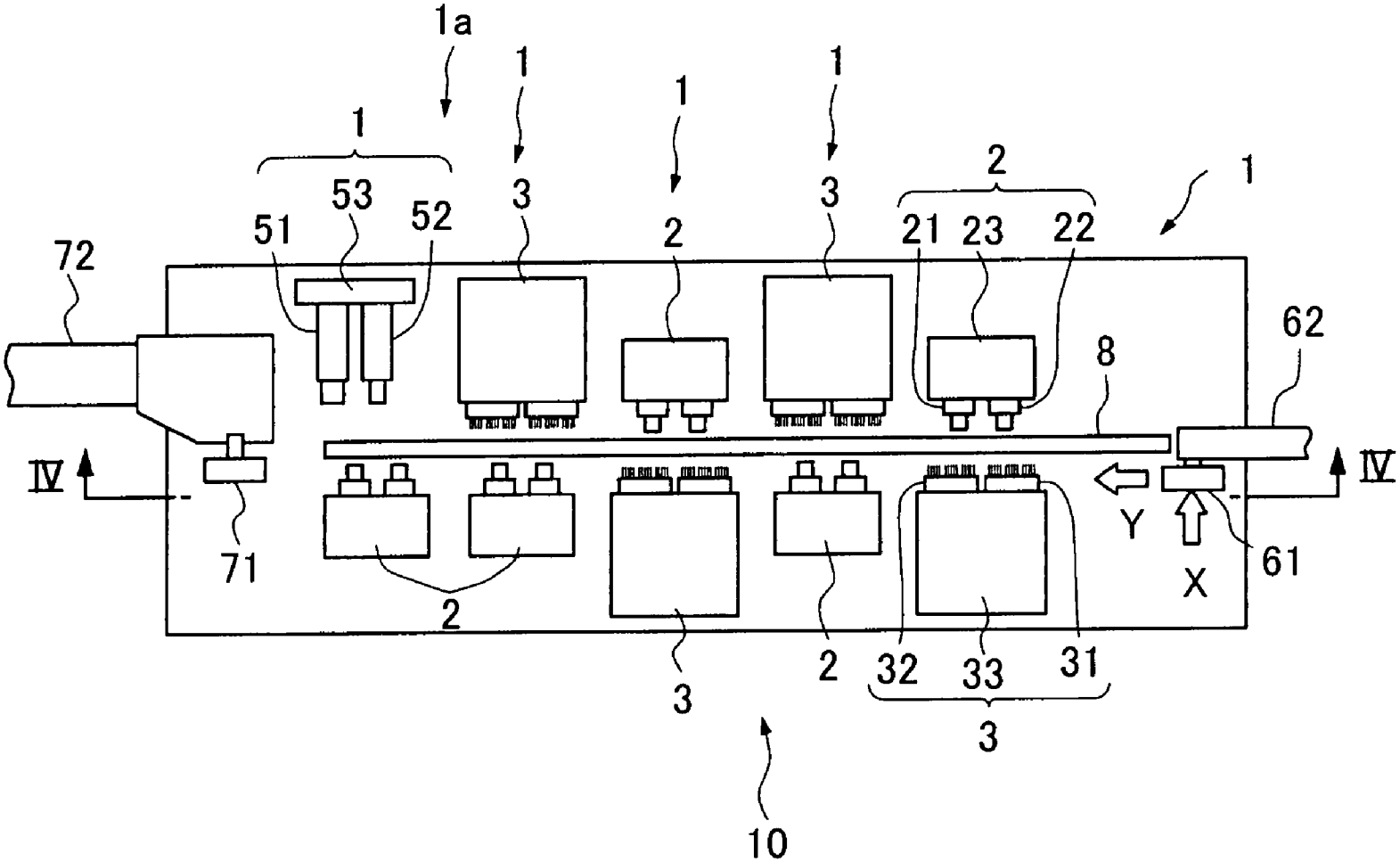
FIG. 3 shows a plan view illustrating an operational status of the grinding system of the invention.
Figure 4:
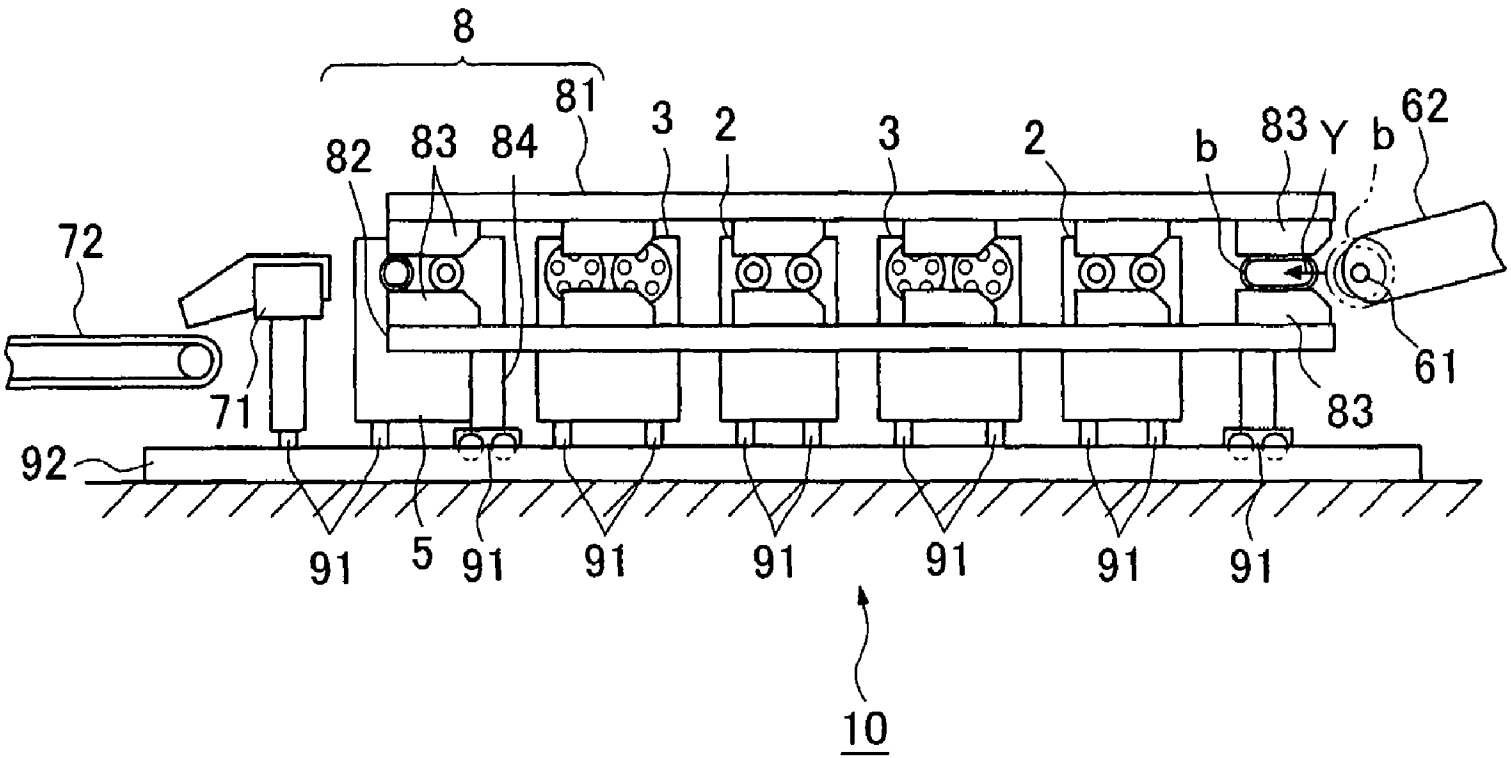
FIG. 4 shows an IV-IV arrow view of FIG. 3.

Referring to FIGS. 3 and 4, the outline of a grinding system 10 is described. The system includes the grinding apparatuses 1, 1, 1, 1 described with reference to FIG. 1 that are disposed at regular intervals. Between the holders 2 and the grinders 3, a transfer 8 is provided that can be reciprocally moved between the adjacent grinding apparatuses. In the grinding apparatuses 1, 1, 1, 1, the arrangements of the holder 2 and the grinder 3 are alternately reversed. This is so that both of the edge surfaces of the belt b can be alternately ground. The belt b introduced into the shooter 62 is sent to the transfer 8 by the loader 61, and is sequentially transferred to the next grinding apparatus 1 as the transfer 8 is reciprocally moved. The subsequent grinding apparatuses 1 include, in order of increasing distance from the shooter 62, an apparatus for coarsely grinding one edge surface of the belt b, an apparatus for coarsely grinding the other edge surface of the belt b, an apparatus for finish-grinding the one edge surface of the belt b, and an apparatus for finish-grinding the other edge surface of the belt b. The transfer 8 is comprised of bar members 81 and 82 at the top and bottom, and of chuck members 83, 83 each attached to the opposite surfaces of the bar members 81 and 82 at the same intervals as those between the individual grinding apparatuses 1, 1. The belt b is transferred while it is held with the chuck members 83, 83. The chuck members 83 are molded of an appropriate material (such as resin material) such that the surface of the belt b would not be damaged as it is chucked. The final grinding apparatus 1*a* is an apparatus for removing an oxide film or the like formed on the external and internal peripheral surfaces of the belt b. It is comprised of a holder 2 similar to the one mentioned above, and a grinder 5 consisting of a casing 53 rotatably supporting two rotating grinders 51 and 52. By the grinding on both edge surfaces, burrs or droops are removed and a required R is provided, and the belt is further ground on both the external and internal peripheral surfaces. The belt b is then collected from the transfer 8 with the loader 71, and is then mounted on a belt conveyor 72. To the lower end of the casing 23 of the holder 2 or of the casing 33 of the grinder 3, of which each grinding apparatus 1, 1, . . . is comprised, casters 91, 91, . . . are attached such that the casters 91, 91, . . . can be moved along rails 92, 92. The holder 2 or grinder 3 of each grinding apparatus 1, 1, . . . is controlled to automatically move toward or away from the transfer 8 at an appropriate timing associated with the reciprocating motion of the transfer 8.

The flow of the operation of the grinding system 10 is described. Initially, as shown in FIGS. 3 and 4, the belt b introduced to the shooter 62 is hooked on the internal surface thereof by the loader 61 as it moves in the direction X indicated by the arrow in FIG. 3. The loader 61 in that posture is then moved in the direction Y indicated by the arrow, whereby the belt b is fitted between the chuck members 83, 83.

Figure 5:
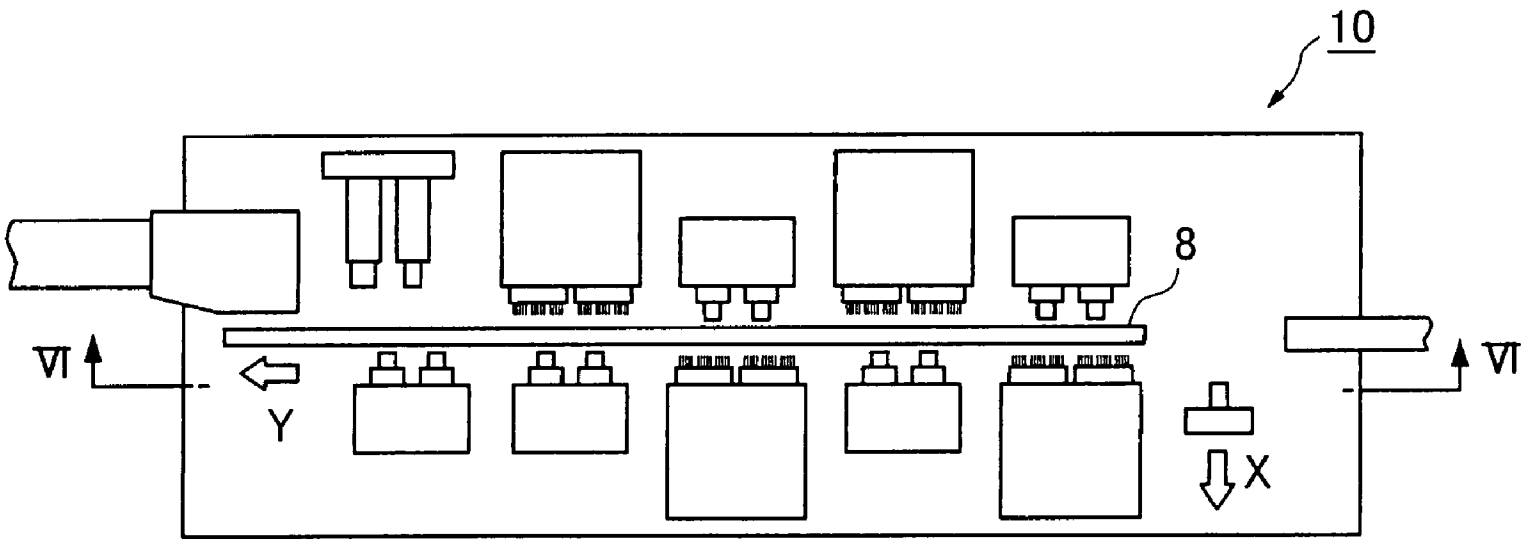
FIG. 5 shows a plan view illustrating an operating status of the grinding system following FIG. 3.
Figure 6:
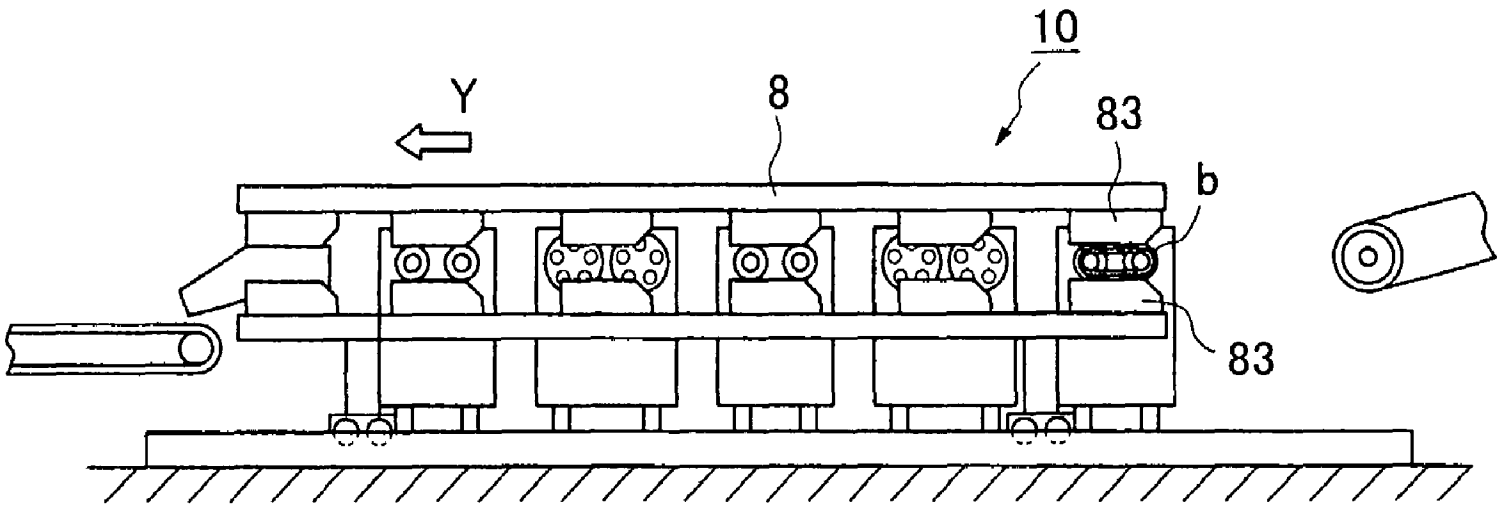
FIG. 6 shows an VI-VI arrow view of FIG. 5.

Now referring to FIGS. 5 and 6, the loader 61, after the belt b is fitted between the chuck members 83, 83, is moved in the direction Y, which is away from the transfer 8. The transfer 8 moves the chucked belt b to the grinding apparatus 1 (arrow Y) for the initial coarse grinding.

Figure 7:
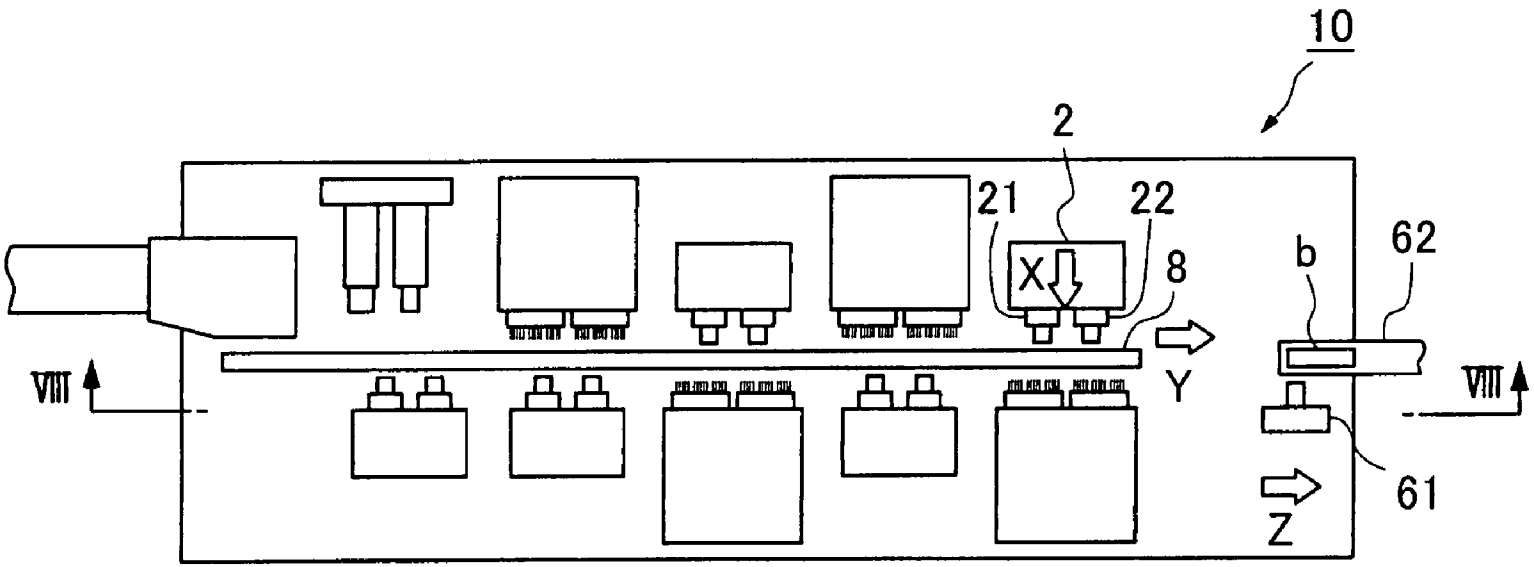
FIG. 7 shows a plan view illustrating an operating status of the grinding system following FIG. 5.
Figure 8:
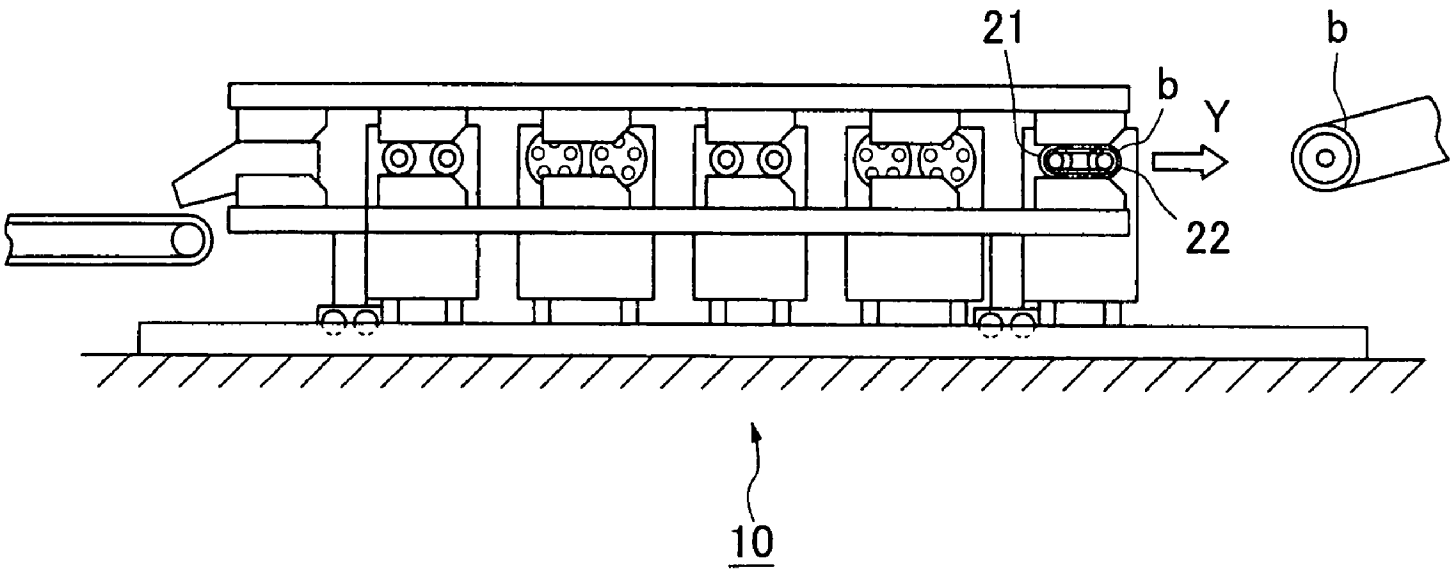
FIG. 8 shows a VIII-VIII arrow view of FIG. 7.

Referring to FIGS. 7 and 8, the holder 2 is moved (arrow X) to the vicinity of the belt b disposed forwardly (arrow X), and the driving roller 21 and the driven roller 22 are brought into partial contact with the internal peripheral surface of the belt b. The driven roller 22 is then moved away from the driving roller 21 (arrow Y); whereby the belt b is stretched between the two rollers in the shape of a track, with the belt b spaced apart from the chuck members 83, 83. Meanwhile, the loader 61 is moved toward the shooter 62 (arrow Z) for the transfer of the next belt b.

Figure 9:
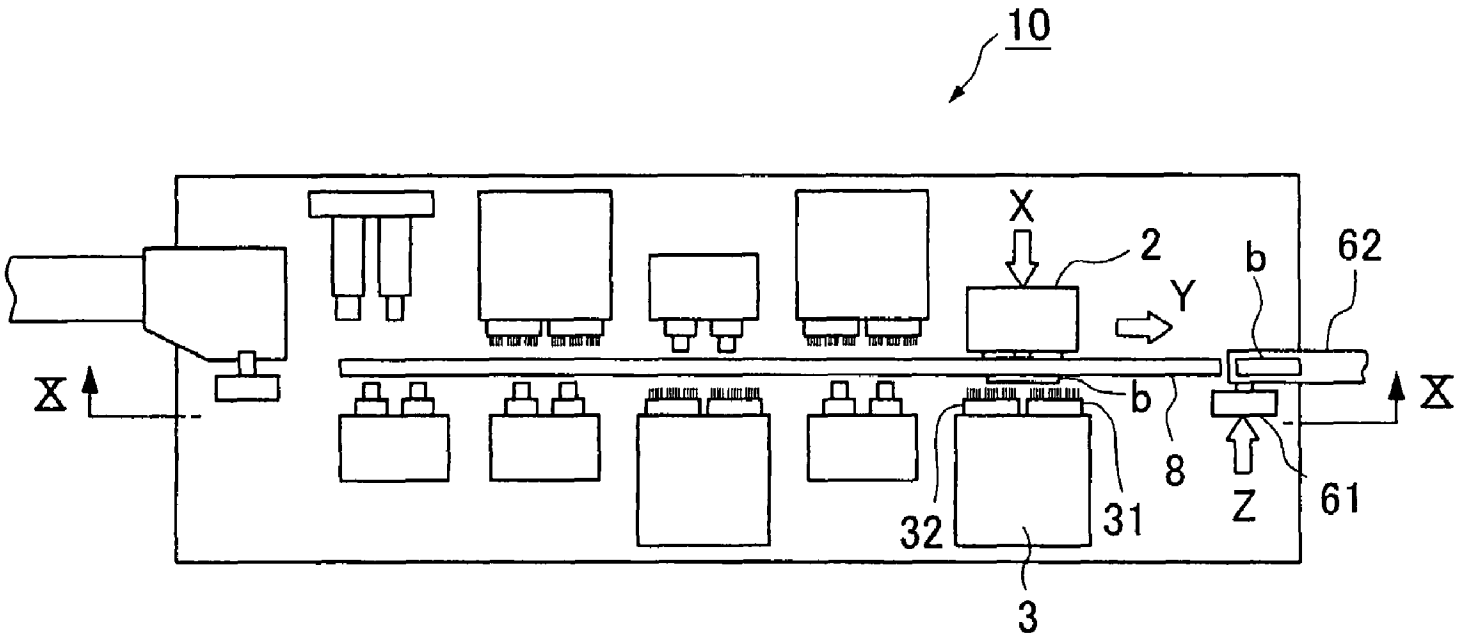
FIG. 9 shows a plan view illustrating an operating status of the grinding system following FIG. 7.
Figure 10:
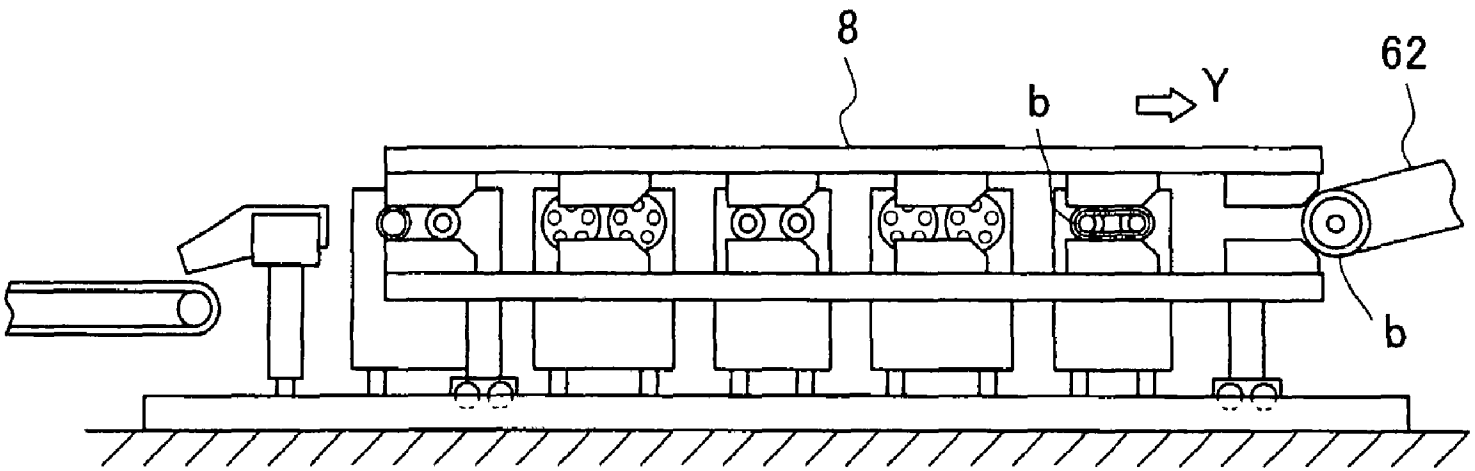
FIG. 10 shows an X-X arrow view of FIG. 9.

Referring to FIGS. 9 and 10, the holder 2 is moved toward the grinder 3 (arrow X) with the belt b stretched between the two rollers in the shape of a track, and then one edge surface of the belt b is coarsely ground while the rotating bodies 31 and 32 are rotated in the same direction. During this coarse grinding step, the belt b is already released from the chuck members 83, 83. Therefore, the reciprocating motion of the transfer 8 does not hinder the coarse grinding. Thus, during the coarse grinding step, the transfer 8 is moved toward the shooter 62 (arrow Y), and it collects the next belt b that is already introduced to the shooter 62. As already mentioned above, the loader 61 is moved toward the belt b (arrow Z) so as to hook the belt b.

Figure 11:
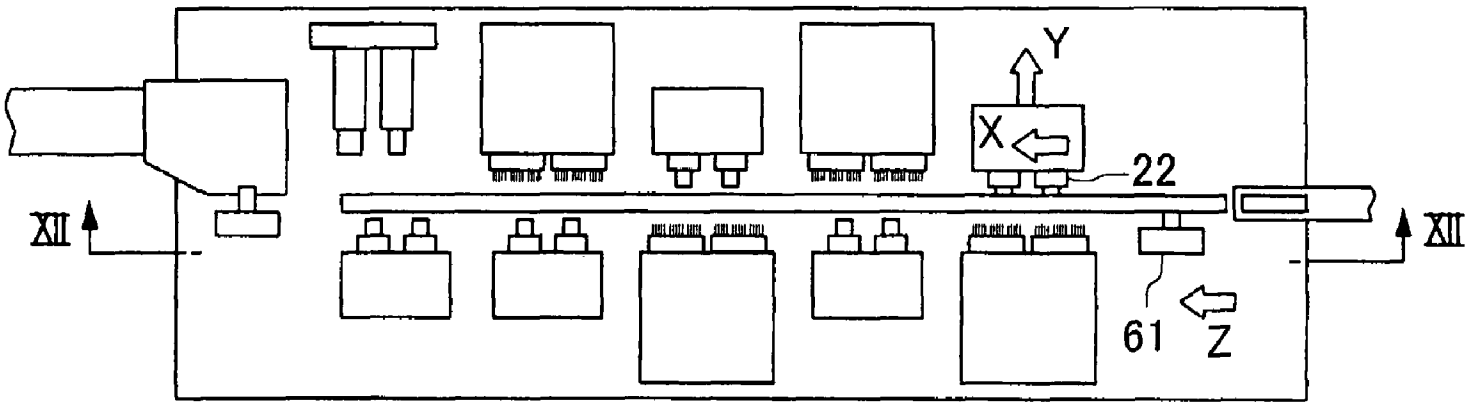
FIG. 11 shows a plan view illustrating an operating status of the grinding system following FIG. 9.
Figure 12:
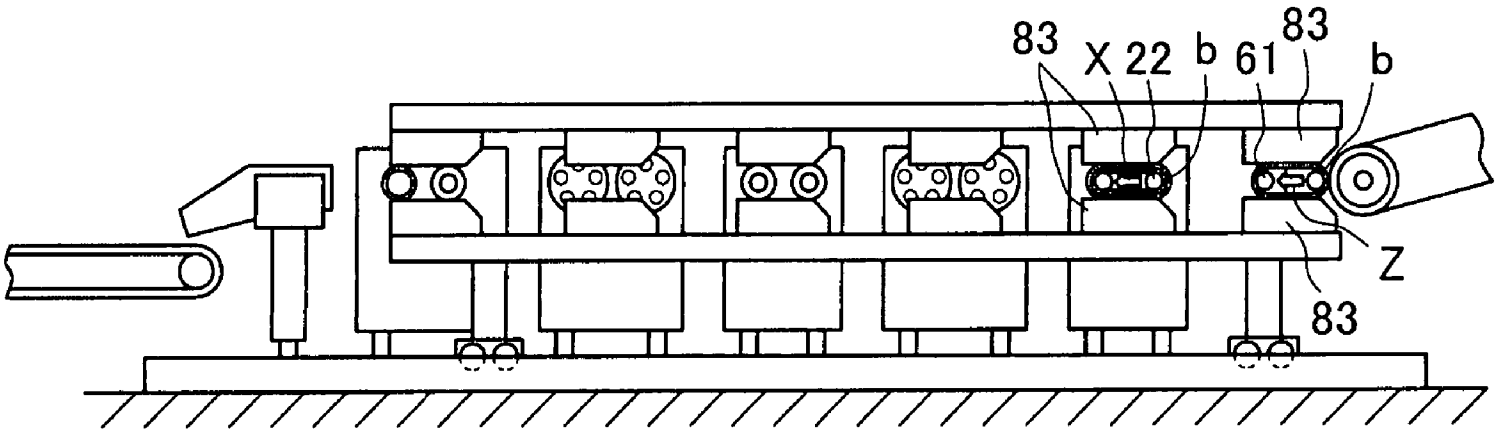
FIG. 12 shows a XII-XII arrow view of FIG. 11.

Referring to FIGS. 11 and 12, the belt b is fitted between the chuck members 83, 83 by the loader 61 (arrow Z). On the other hand, when the coarse grinding of one edge surface of the belt b is completed, the holder 2 is moved slightly apart from the grinder 3 (arrow Y), and the belt b is disposed between the opposed chuck members 83, 83. In this state, the driven roller 22 is moved toward the driving roller 21 (arrow X), whereby the belt b stretched between the two rollers is released and held between the chuck members 83, 83.

Figure 13:
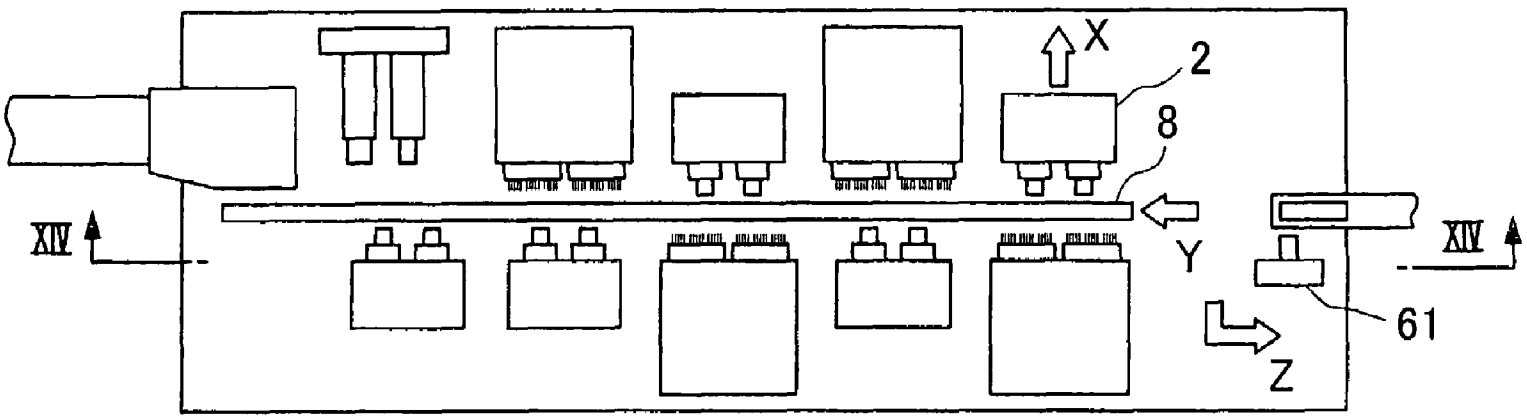
FIG. 13 shows a plan view illustrating an operating status of the grinding system following FIG. 11.
Figure 14:
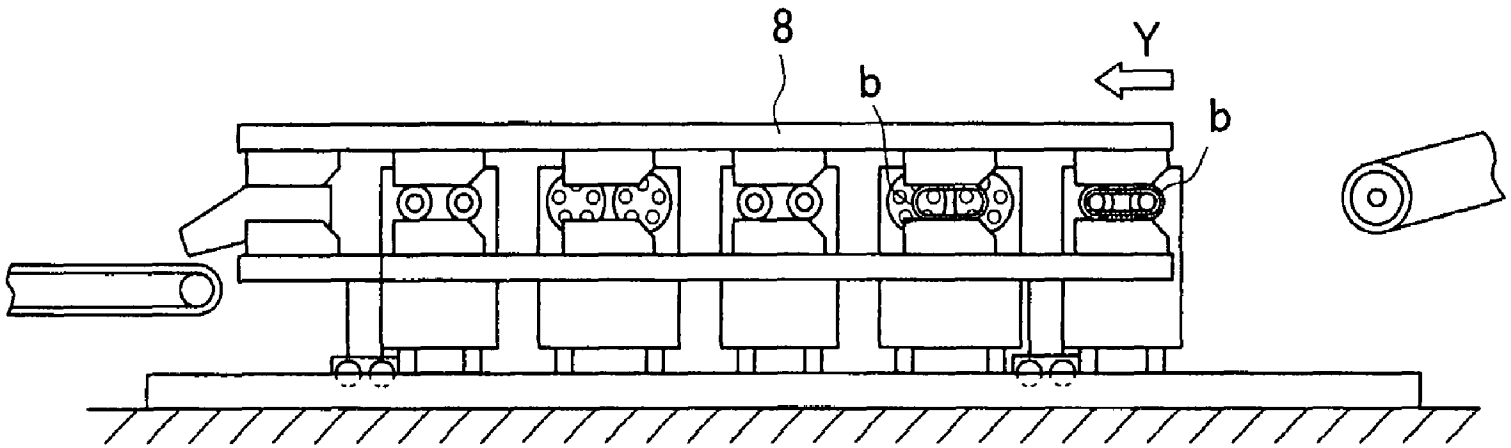
FIG. 14 shows a XIV-XIV arrow view of FIG. 13.

Referring to FIGS. 13 and 14, the holder 2 is moved back to the extent that it does not hinder the transfer 8 (arrow X), and the transfer 8 with the two belts b, b held thereby is moved (arrow Y). This movement is performed so as to transfer the belt b, of which one edge surface has been coarsely ground, to the next grinding apparatus 1. Thus, the next belt b is transferred to the grinding apparatus 1 where the initial coarse grinding is performed. At the same time, the loader 61 is moved toward the shooter 62 so as to accommodate the belt b (arrow Z).

Figure 15:
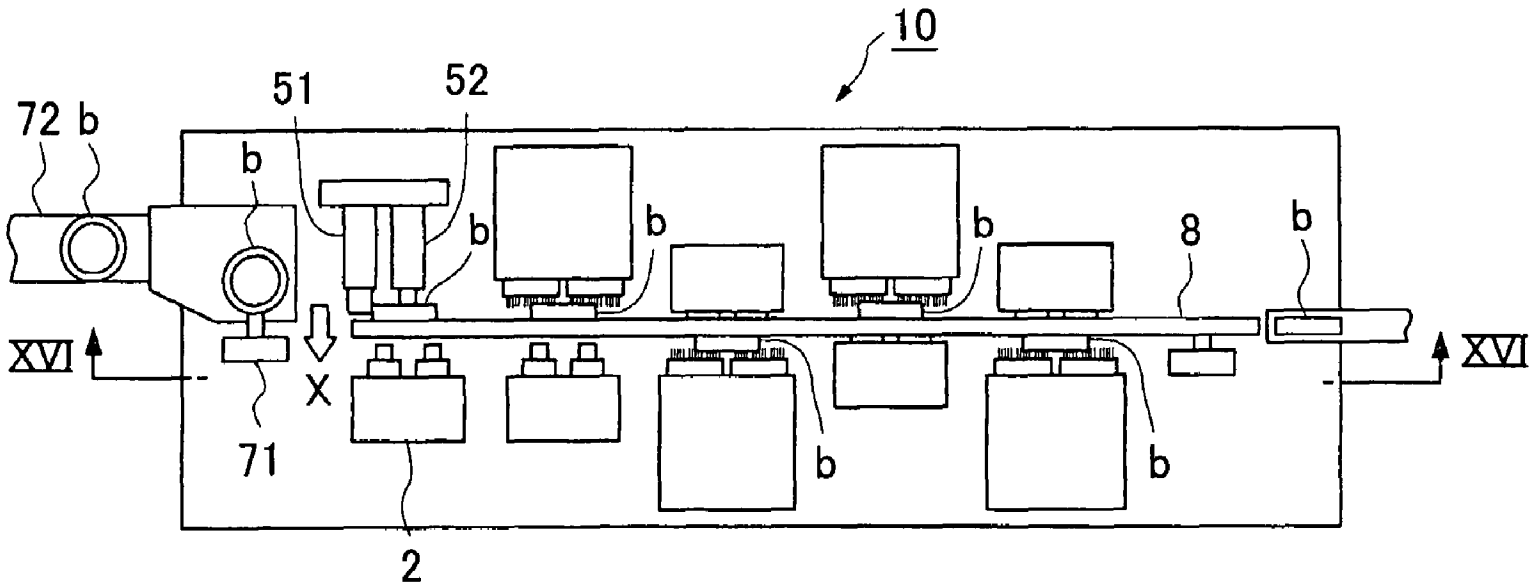
FIG. 15 shows a plan view illustrating an operating status of the grinding system following FIG. 13.
Figure 16:
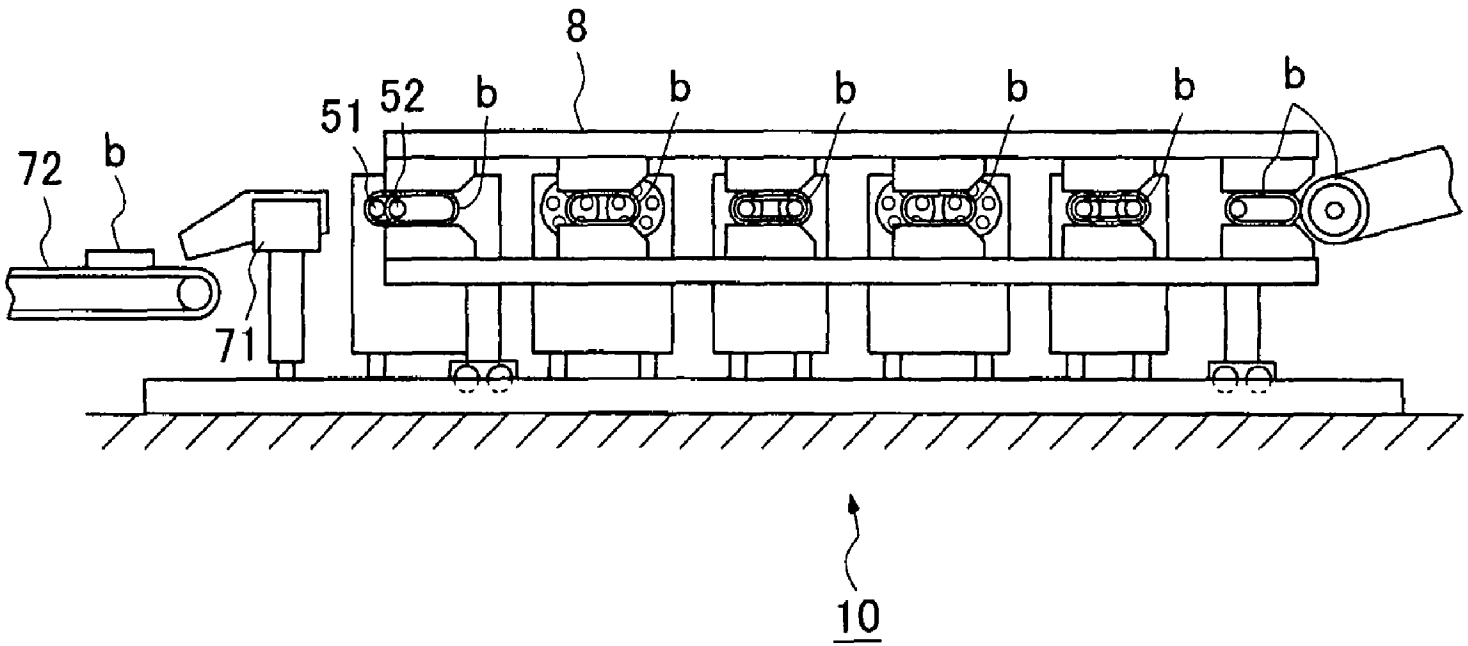
FIG. 16 shows a XVI-XVI arrow view of FIG. 15.
Figure 17:
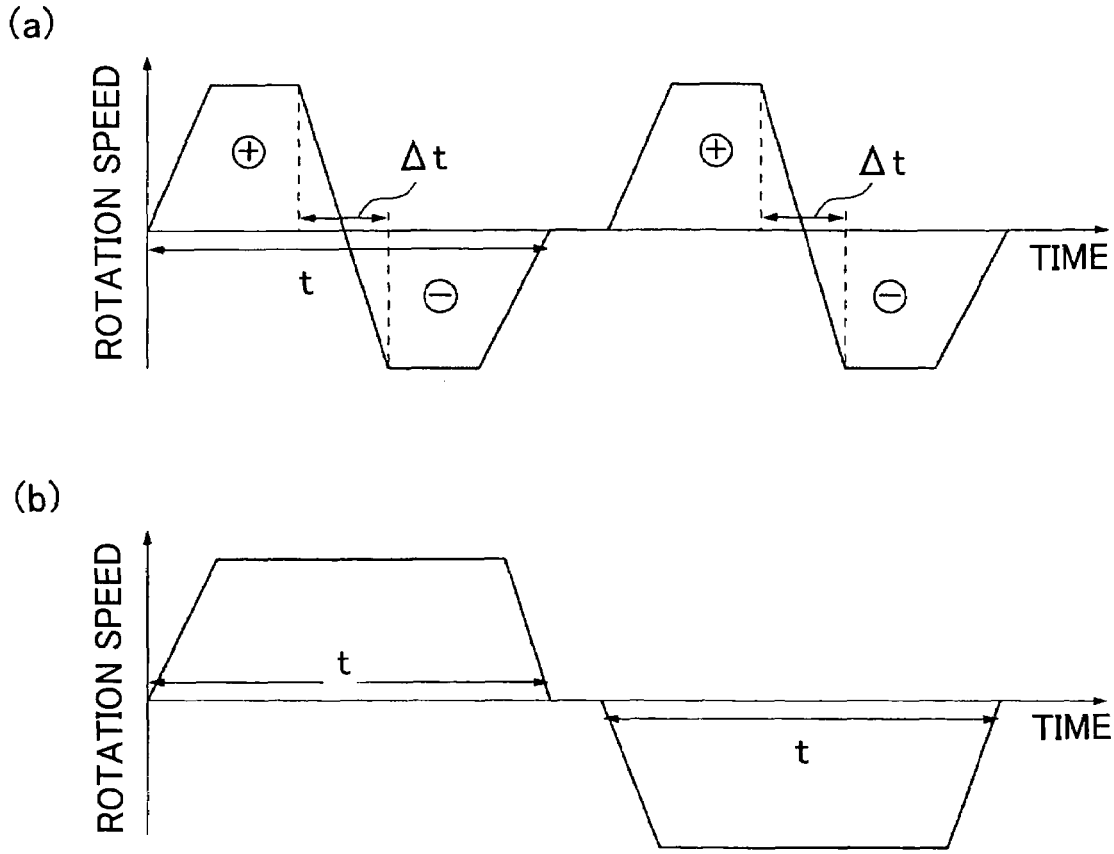
FIG. 17 shows a time history waveform of rotation control of the rotating bodies in the grinding apparatus.
Figure 18:
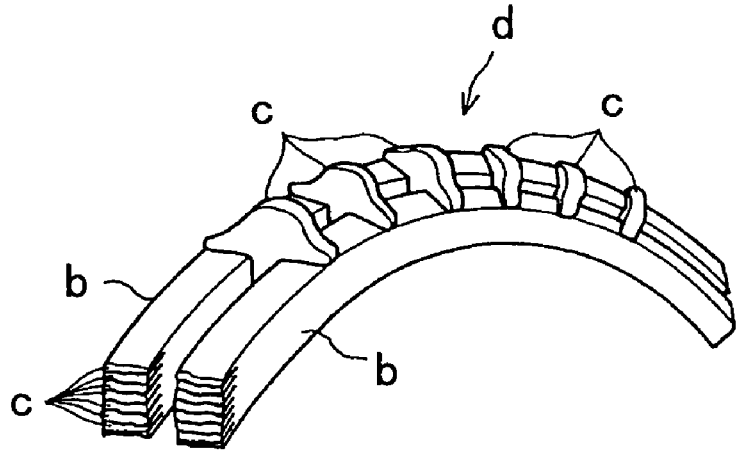
FIG. 18(*a*) shows a perspective view of a part of a CVT belt.
Figure 18:
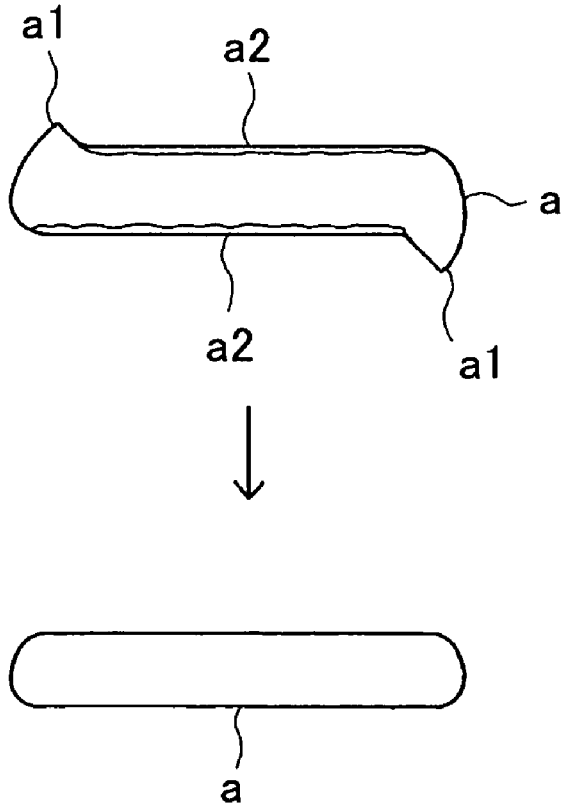

Referring to FIGS. 15 and 16, as the above sequence is performed, the belt b of which one edge surface has been ground is transferred to the next grinding apparatus 1. At the same time, a new belt b is collected from the shooter 62. For the final grinding of the external and internal circumferential surfaces, the grinder 5 is moved toward the transfer 8 (arrow X), and then the external circumferential surface of the belt b is ground by the grinding rotating body 51 while the internal peripheral surface is ground by the grinding rotating body 52.

After the grinding of the belt b is completed, the belt b is moved via the loader 71 to the belt conveyor 72 for transportation.

In accordance with the grinding system of the invention, the coarse grinding and the finish grinding of the belt edge surfaces, and the grinding of the external and internal circumferential surfaces of the belt, can be all automatically performed. Because the extent of wear of the nylon wire rods mounted on the rotating bodies, of which each grinder is composed, is automatically detected, a predetermined pressing force can be constantly maintained and the time loss associated with the replacement of the nylon wire rods can be minimized.

Now referring to FIG. 17, the outline of the rotation control of the rotating bodies attached to the grinder is described. When the direction of rotation of the rotating body is fixed in one way, the nylon wire rods acquire, as the grinding proceeds, a tendency to flow in the direction opposite to the direction of rotation. As such tendency to flow in one direction develops in the brush, the grinding force of the brush greatly decreases, eventually requiring the replacement of the brush. Thus, so as to prevent the development of such tendency in the brush, the direction of rotation of the rotating body is conventionally alternately reversed when grinding the edge surface of a single belt, as shown in FIG. 17*a*.

In this case, as will be seen from FIG. 17*a*, of the time t required to grind the edge surface of a single belt, rotation switch time ? t is additionally required between the constant rotation speed in the positive direction (+ side in the figure) and the constant rotation speed in the opposite direction (– side in the figure), thus adversely affecting the efficiency of grinding processing.

Thus, in accordance with the grinding system of the invention, the direction of rotation of the rotating bodies is changed for from one belt to the next. As will be seen from FIG. 17*b*, the wasteful switching time required for the switching of the direction of rotation can be eliminated. Thus, by changing the direction of rotation of the rotating bodies when the belt is moved, efficient grinding can be realized.

While the embodiments of the invention have been described with reference to the drawings, the invention is not limited to the foregoing specific embodiments, but various design changes or the like may be made within the scope of the invention. For example, in addition to the rotation of the rotating bodies attached to the grinder, each segment brush disposed in the circumferential direction thereof may be rotated about its own axis.

The invention claimed is:

1. A grinding apparatus comprising:

a holder having two rollers rotating about two parallel axes for holding a belt to be ground; and a first grinding brush and a second grinding brush disposed opposite the holder, wherein the first brush and second brush are rotated and spaced apart such that the first brush and second brush do not interfere with each other, wherein the belt is stretched between the two rollers and is rotated by the rotation of the rollers for grinding, wherein upon rotation the first grinding brush enters toward an edge surface of the belt, which is located between the two rollers, from one side of the belt, while the second grinding brush upon rotation enters toward the edge surface of the belt from the other side of the belt, wherein the first grinding brush and the second grinding brush repeatedly enter and emerge from the edge surface of the rotating belt stretched between the two rollers upon rotation of the two rollers.

2. The grinding apparatus according to claim 1, further comprising:

a grinder comprising a first rotating body having a plurality of the first grinding brushes disposed in the circumferential direction thereof, and a second rotating body having a plurality of the second grinding brushes in the circumferential direction thereof, and wherein the first rotating body and the second rotating body are rotated in the same direction.

3. The grinding apparatus according to claim 1 or 2, wherein the rollers consist of a driving roller and a driven roller, of which one or both are movable such that one roller can be moved away from the other roller.

4. The grinding apparatus according to claim 1, wherein the belt is a continuously variable transmission (CVT) belt comprised of a stack of a plurality of metal rings.

5. A grinding system comprising a plurality of the grinding apparatuses according to claim 1, wherein the grinding system comprises a transfer means for sequentially transferring the belt and for allowing the belt to be detached from or attached to the roller of each grinding apparatus, and wherein, after one edge surface of the belt is ground by an appropriate grinding apparatus, the other edge surface of the belt is ground by another grinding apparatus.

6. The grinding system according to claim 5, further comprising a grinding apparatus for grinding the internal and external circumferential surfaces of the belt.

7. The grinding system according to claim 5, wherein the first rotating body and the second rotating body are adjusted such that their rotation direction is changed from one belt to the next that are transferred.

8. A method for grinding a belt using a grinding system comprising a plurality of the grinding apparatus according to claim 1, wherein the belt is sequentially transferred by each of the grinding apparatuses, and wherein the belt is automatically attached to or detached from the rollers of each grinding apparatus, the method comprising:

grinding one edge surface of the belt with an appropriate grinding apparatus;

automatically detaching the ground belt from the grinding apparatus;

transferring the belt to the next grinding apparatus;

automatically attaching the belt to the grinding apparatus; and grinding the other edge surface of the belt.

9. The grinding method according to claim 8, comprising:

coarsely grinding one edge surface of the belt with an appropriate grinding apparatus;

coarsely grinding the other edge surface of the belt with a next grinding apparatus;

finish-grinding one edge surface of the belt with a next grinding apparatus;

finish-grinding the other edge surface of the belt with a next grinding apparatus; and grinding the external and internal circumferential surfaces of the belt with a next grinding apparatus.

* * * * *